United States Patent [19]

Miyata et al.

[11] 4,129,766

[45] Dec. 12, 1978

[54] INDICATING MECHANISM FOR PUSH BUTTON SWITCHES

[75] Inventors: Hiroyasu Miyata; Sadayoshi Iwasaki, both of Furukawa, Japan

[73] Assignee: Alps Electric Co., Ltd., Japan

[21] Appl. No.: 787,542

[22] Filed: Apr. 14, 1977

[30] Foreign Application Priority Data

Apr. 22, 1976 [JP] Japan ..... 51-50463[U]

[51] Int. Cl.[2] ..... H01H 9/16

[52] U.S. Cl. ..... 200/308; 200/328; 200/340

[58] Field of Search ..... 200/308, 320, 328, 329, 200/330, 340

[56] References Cited

U.S. PATENT DOCUMENTS

| | | | |
|---|---|---|---|
| 3,715,548 | 2/1973 | Schadow | 200/308 |
| 4,044,213 | 8/1977 | Kinney | 200/38 |

*Primary Examiner*—Ro E. Hart

*Attorney, Agent, or Firm*—Guy W. Shoup; Gerard F. Dunne

[57] ABSTRACT

An indicating mechanism for use with a pushbutton switch is disclosed which comprises a hollow nob, a window formed of a transparent plate attached to one end of the hollow nob, an indicating member having an indicating surface and a leg portion formed with a recess for permitting the indicating member to move the interval equal to the width of the recess, two or more resilient plates each having a curved portion and disposed within the hollow nob so that the curved portions can cover the indicating surface of the indicating member when the indicating surface is moved away from the transparent plate and can hold the indicating member when the indicating surface is moved near to the transparent plate.

1 Claim, 4 Drawing Figures

INDICATING MECHANISM FOR PUSH BUTTON SWITCHES

BACKGROUND OF THE INVENTION

The invention relates to an indicating mechanism for use with pushbutton switches.

Indicating mechanisms associated with pushbutton switches are already well known in the art. For example, such an indicating mechanism is described in Japanese Kokai No. 47-35768 U.S. Pat. No. 3,715,548. However, such an indicating mechanism has a shutter rotatably mounted only by a pin and not positively fixed, and accordingly, the shutter will vibrate due to vibrations propagated from a speaker or the like to produce abnormal sounds. Furthermore, in effecting push-push operation (in which the first push of the operation rod causes it to be held in a lock position and the second push thereof causes it to be released from the lock position -- play exists (the operation rod returns slightly after it is fully pushed). This causes an indicating surface to move away from a window after the indicating surface moves near to the window, resulting in the reduction of its indicating ability. In order to overcome this disadvantage in the past, a spring member has been provided to urge the indicating surface against the window.

SUMMARY OF THE INVENTION

Therefore, it is an object of the present invention to provide an improved indicating mechanism for use with a pushbutton switch which will be free from the above mentioned and other disadvantages of the prior art mechanisms.

Another object of the present invention is to provide an indicating mechanism for use with a pushbutton switch which will be easy and inexpensive to manufacture and simple and rugged in structure.

Still another object of the present invention is to provide an improved indicating mechanism for use with a pushbutton switch which will accomplish a clear indication of switch operating conditions.

In accordance with the present invention, there is provided an improved indicating mechanism for use with a pushbutton switch comprising a hollow nob, a window formed of a transparent plate attached to one end of the nob, an indicating member having an indicating surface and a leg portion formed with a recess for permitting the indicating member to move the interval equal to the width of the recess, more than two resilient plates each having a curved portion and disposed within the nob so that the curved portions can cover the indicating surface of the indicating member when the indicating surface is moved away from the transparent plate and can hold the indicating member when the indicating surface is moved near to the transparent plate.

BRIEF DESCRIPTION OF THE DRAWINGS

For a better understanding of this invention, reference is now made to the following description taken in connection with the accompanying drawings, in which.

DESCRIPTION OF A PREFERRED EMBODIMENT

Figure 1:
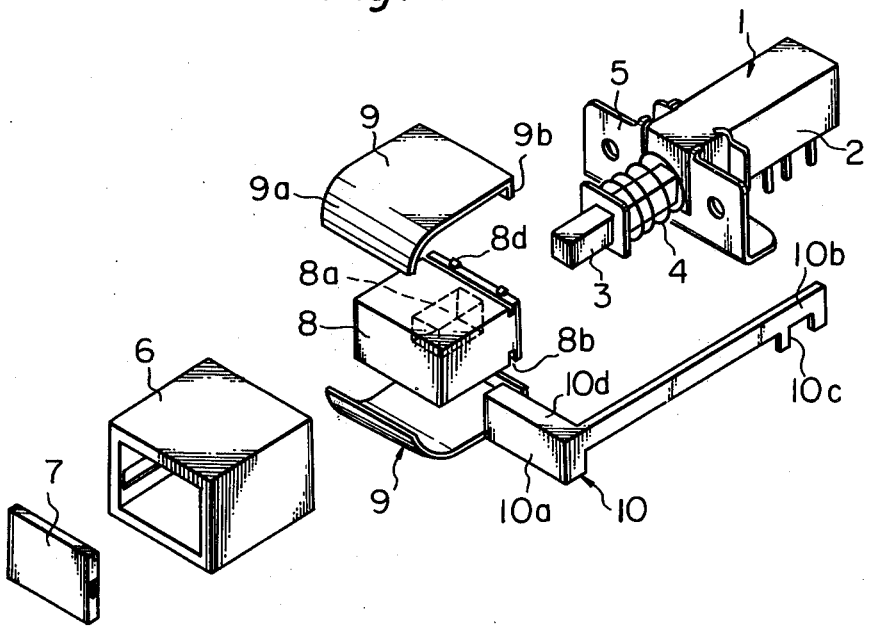
FIG. 1 is a perspective view showing an indicating mechanism in accordance with the present invention in an exploded fashion.

Referring now to the drawings and initially to FIG. 1 thereof, there is illustrated an indicating mechanism for use with a pushbutton switch 1 which includes a housing 2, a switch operation rod or slide 3, a spring member 4 for biasing the switch operating rod 3 into the original position, and an attachment frame 5 for attachment of the switch 1. The indicating mechanism includes a hollow nob 6 formed of a synthetic resin and a window 7 formed of a transparent plate attached to one end of the hollow nob 6. Also included in the indicating mechaism is a supportor 8 formed with a recess 8*a* for insertion of the switch operation rod 3 and upper and lower grooves 8*b* each for insertion of one end of a respective resilient member or plate 9. Each of the resilient plates 9 is formed of a resilient material such as, for example a phosphor bronze plate and is formed at its one end with a curved portion 9*a* and at the other end with a portion 9*b* bent substantially at a right angle to be inserted in the respective groove 8*b* of the supporter 8. The two resilient plates are disposed over the supporter 8 so that their bent portions 9*b* are inserted in the respective grooves 8*b* and the tip ends of their curved portions 9*a* abut each other. The indicating mechanism also includes an indicating member 10 formed substantially in an L-shape and composed of an indicating surface 10*a* and a leg portion 10*b* formed with a recess 10*c* for engagement with the attachment frame 5. The supporter 8 also is formed with projections 8*d* for locking the supporter 8 in a position within the hollow nob 6.

The assembly of the indicating mechanism of the present invention will now be described as follows: First, the head portion of the switch operating rod 3 is inserted into the recess 8*a* of the supporter 8. Then, following insertion of the bent portions 9*b* and 9*b* of the resilient plates 9 and 9 into the grooves 8*b* and 8*b* of the supporter 8, the indicating member 10 is positioned so that its indicating surface 10*a* is interposed between the supporter 8 and the curved portions 9*a* and 9*a* of the resilient plates 9 and 9 and its leg portion 10*b* is engaged with the attachment frame 5. Finally, the assembly of the supporter 8, the resilient plates 9, and the indicating member 10 are inserted into the hollow nob provided with the transparent plate 7 from the other end of the nob 6 opposite to the transparent plate 7 until the projections 8*d* of the supporter 8 are fitted into the recesses, not shown, formed in the inner walls of the hollow nob 6.

Figure 2:
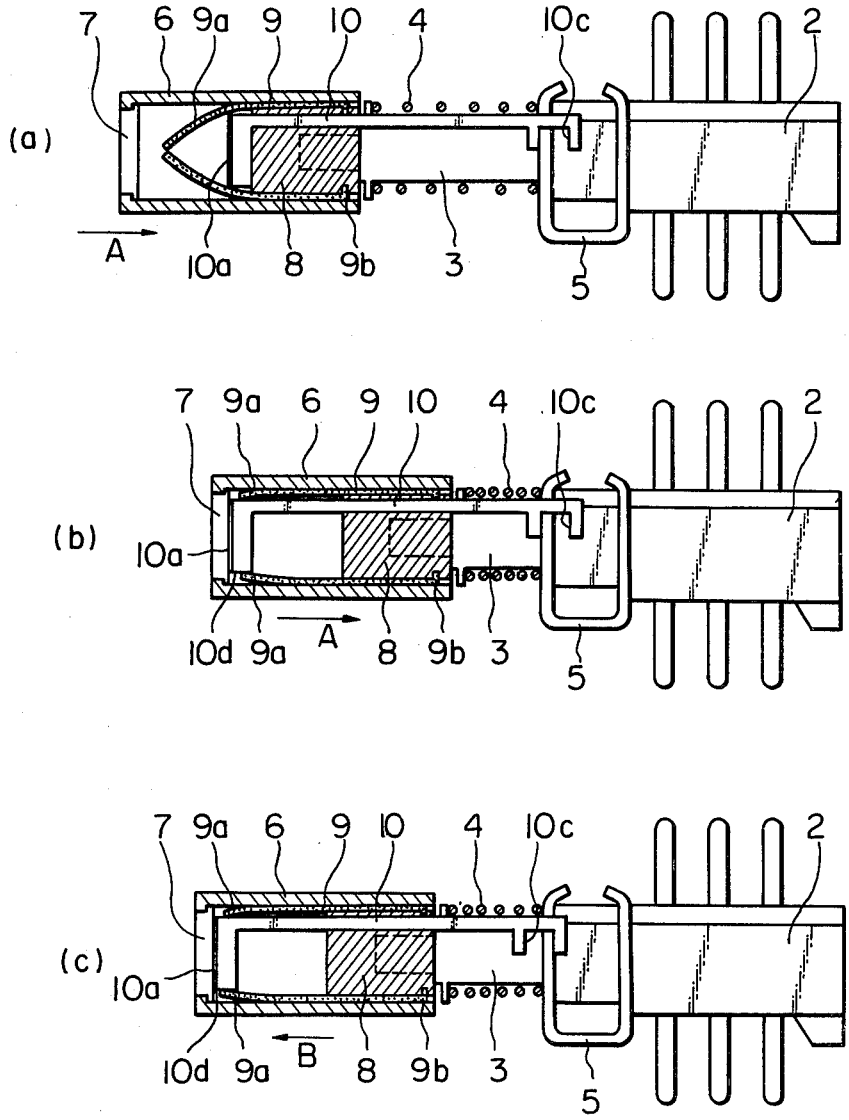
FIGS. 2(*a*) through 2(*c*) are sectional views for use in explaining the operation of the indicating mechanism of the present invention.

The operation of the indicating mechanism for use with a pushbutton switch in accordance with the present invention will now be described with reference to FIG. 2. FIG. 2(*a*) shows the indicating mechanism for use with a pushbutton switch with the switch operating rod 3 being placed in its original position and the switch being placed in the "OFF" condition. In this condition, the curved portions 9*a* and 9*a* of the resilient plates 9 and 9 are in abutment to each other and the indicating surface 10*a* of the indicating member 10 cannot be viewed from the transparent plate side. When the nob 6 is pushed to move the assembly of the supporter 8, the resilient plates 9 and 9, and the switch operating rod 3 in the direction indicated by the arrow A, the end portion of the indicating surface 10*a* of the indicating member 10 engaged with the attachment frame 5 serves to expand the curved portions 9*a* and 9*a* of the resilient plates 9 and 9. When the hollow nob 6 is pushed fully (see FIG. 2(*b*), the indicating surface 10*a* of the indicating member 10 comes substantially into contact with the transparent plate so that the indicating surface 10*a* can be viewed from the transparent plate side. At this time, the ends of the curved portions 9*a* and 9*a* of the resilient plates 9 and 9 hold the side walls 10*d* and 10*d* of the indicating member 10. After the nob 6 is fully pushed and returns slightly in the direction indicated by the arrow B, the switch operating rod 3 is locked in a second position and the switch is turned on. At the time, the indicating member 10 is held by the resilient plates 9 and 9 and accordingly, it moves along with the nob 6 into the condition shown in FIG. 2(*c*) so that the indicating surface 10*a* is maintained substantially in contact with the transparent plate 7. When the nob 6 is pushed once again, the switch operating rod 3 is released from the lock position and the switch is turned off, while at the same time the switch operating rod 3 is moved to the original position through the force of the spring member 4 and the indicating member 10 is moved in the direction indicated by the arrow B through the resilient force of the resilient plates 9 and 9 themselves as shown in FIG. 4(*a*).

As described above, the indicating mechanism of the present invention comprising more than two resilient plates each formed with a curved portion, the plates located to cover the indicating surface of an indicating member so that the indicating surface can viewed from the transparent window and the curved portions of the resilient plates hold the indicating member when the nob is pushed, is simple and rugged in structure and easy and inexpensive to produce and can provide a clear indication of switch operating conditions.

The invention has been described in detail with reference to a preferred embodiment thereof, but it will be understood that variations and modifications can be effected within the spirit and scope of the invention. For example, more than two resilient plates can be used instead of two resilient plates.

What is claimed is:

1. In an indicating mechanism for a pushbutton switch having a slide movable between a first outer position and a second inner position, said slide being movable inwardly past said second position for locking or unlocking said slide from said second position; said indicating mechanism comprising a hollow nob adapted to be connected for movement with said slide and having a transparent window in its end portion;

an indicating member having an indicating surface disposed slidably within said nob; and at least two shutter members disposed within said nob and having portions able to extend between said indicating surface and said window for preventing said indicating surface from being viewed through said window;

the improvement comprising:

said shutter members being formed from a resilient material and having said portions thereof biased towards one another; and means for moving said shutter members with said nob;

whereby as the switch slide is pushed from its first position, said indicating surface will be moved between said portions of the shutter members to spread them apart resiliently to permit visual detection of said indicating surface and as the switch slide returns back from being pushed passed its second position, said portions of the shutter members will resiliently hold said indicating member near said window.

* * * * *